US010472794B2

(12) United States Patent
Iida

(10) Patent No.: US 10,472,794 B2
(45) Date of Patent: Nov. 12, 2019

(54) FRONT LOADER AND WORK VEHICLE EQUIPPED WITH THE SAME

(71) Applicant: Yanmar Co., Ltd., Osaka-shi, Osaka-fu (JP)

(72) Inventor: Tetsuya Iida, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 15/770,934

(22) PCT Filed: Oct. 27, 2015

(86) PCT No.: PCT/JP2015/080175
§ 371 (c)(1),
(2) Date: Apr. 25, 2018

(87) PCT Pub. No.: WO2017/072845
PCT Pub. Date: May 4, 2017

(65) Prior Publication Data

US 2018/0313056 A1 Nov. 1, 2018

(51) Int. Cl.
*E02F 3/34* (2006.01)
*E02F 3/38* (2006.01)
(Continued)

(52) U.S. Cl.
CPC ..... *E02F 3/34* (2013.01); *E02F 3/342* (2013.01); *E02F 3/38* (2013.01); *E02F 3/6273* (2013.01)

(58) Field of Classification Search
CPC . E02F 3/34; E02F 3/342; E02F 3/6273; E02F 3/38
See application file for complete search history.

(56) References Cited

U.S. PATENT DOCUMENTS 1,491,535 A * 4/1924 Husher ..... E02F 3/38 414/727
5,152,659 A 10/1992 Waka
(Continued)

FOREIGN PATENT DOCUMENTS

EP 2402512 A2 1/2012
JP 6-146322 A 5/1994
(Continued)

OTHER PUBLICATIONS

Extended European search report dated Nov. 6, 2018 issued in corresponding EP Application No. 15907209.9 cites the patent documents above.
(Continued)

*Primary Examiner* — Michael S Lowe
(74) *Attorney, Agent, or Firm* — Norton Rose Fulbright US LLP

(57) ABSTRACT

A front loader including: a pair of masts provided to a machine body frame of a work vehicle in a detachable manner; a pair of lifting arms coupled to the masts in a vertically rotatable manner; and a work equipment mounted to the lifting arms. Each lifting arm includes a front lifting arm attached to one of the masts and a rear lifting arm attached to the work equipment, each of the front lifting arm and the rear lifting arm has a hollow, rectangular cross-section. The rear end portion of the front lifting arm is inserted into the front end portion of the rear lifting arm, and is welded. The side plate of the rear lifting arm at a location corresponding to the insertion portion has a protruding portion that extends along the side plate of the front lifting arm, and the protruding portion is welded.

4 Claims, 12 Drawing Sheets

(51) Int. Cl.
*E02F 3/627* (2006.01)
*E02F 3/342* (2006.01)

(56) References Cited

U.S. PATENT DOCUMENTS

| | | | | |
|---|---|---|---|---|
| 6,171,050 | B1 * | 1/2001 | Johnson | E02F 3/34 414/685 |
| 8,631,580 | B2 * | 1/2014 | Randall | B66F 9/07513 29/897.2 |
| 2003/0082040 | A1 * | 5/2003 | Bares | E02F 3/34 414/680 |
| 2006/0182597 | A1 | 8/2006 | Higashikawa et al. | |
| 2006/0245899 | A1 * | 11/2006 | Lyons | E02F 3/6273 414/686 |
| 2011/0140402 | A1 | 6/2011 | Lanting et al. | |
| 2014/0064835 | A1 | 3/2014 | Lanting et al. | |

FOREIGN PATENT DOCUMENTS

| | | | |
|---|---|---|---|
| JP | 2006-188858 | A | 7/2006 |
| JP | 2006-207236 | A | 8/2006 |
| JP | 2014-025313 | A | 2/2014 |
| WO | 2006/036105 | A1 | 4/2006 |

OTHER PUBLICATIONS

International Search Report dated Jan. 26, 2016 issued in corresponding PCT Application PCT/JP2015/080175 cites the patent documents above.

* cited by examiner

FRONT LOADER AND WORK VEHICLE EQUIPPED WITH THE SAME

CROSS REFERENCES TO RELATED APPLICATIONS

This application is a national stage application pursuant to 35 U.S.C. § 371 of International Application No. PCT/JP2015/080175, filed on Oct. 27, 2015, the disclosures of which are hereby incorporated by reference in their entireties.

TECHNICAL FIELD

The present invention relates to a front loader and a work vehicle equipped with the front loader.

BACKGROUND ART

Patent Literature 1 (PTL 1) discloses a front loader that is detachably mounted to a tractor serving as a work vehicle. The front loader is composed mainly of a pair of left and right main frames which are provided in a vehicle body frame of the tractor in a detachable manner, a pair of left and right booms coupled to the main frames in a vertically rotatable manner, work equipment mounted to the pair of left and right booms, and the like.

The boom includes a front boom component, a rear boom component, and a coupling plate coupling the front boom component and the rear boom component arm, and overlap portions where the front boom component overlaps the coupling plate and where the rear boom component overlaps the coupling plate are welded.

CITATION LIST

Patent Literature

PTL 1: Japanese Patent Application Laid-Open No. 2014-025313

SUMMARY OF INVENTION

Technical Problem

The load capacity of a lifting arm (boom) included in the front loader is prescribed based on, for example, a stress occurring in a welded portion between the front boom component and the coupling plate and in a welded portion between the rear boom component and the coupling plate. In a configuration in which the lifting arm (boom) included in the front loader is composed of a plurality of parts being welded as mentioned above, a stress may concentrate in the welded portion depending on the shape of the welded portion of each part, which may be a limiting factor of the load capacity of the lifting arm included in the front loader.

The present invention provides: a front loader capable of reducing a stress concentration which can occur in a welded portion of the lifting arm; and a work vehicle equipped with the front loader.

Solution to Problem

A front loader according to an aspect of the present invention is a front loader including: a pair of left and right masts provided to a machine body frame in a detachable manner; a pair of left and right lifting arms coupled to the masts in a vertically rotatable manner; and a work equipment mounted to the pair of left and right lifting arms, wherein each of the lifting arms includes a rear lifting arm attached to one of the masts and a front lifting arm attached to the work equipment, the front lifting arm having an insertion portion to be inserted into the rear lifting arm, the rear lifting arm has a side plate whose front end portion is provided with a protruding portion that extends along a side plate of the front lifting arm, and an upper edge of the protruding portion extends along the side plate of the front lifting arm farther than a lower edge of the protruding portion, and under a state where the front lifting arm is inserted into the rear lifting arm, an overlap portion where the insertion portion overlaps the protruding portion is welded so that the front lifting arm is fixed to the rear lifting arm.

The upper edge of the protruding portion may be curved in an S-shape.

The front lifting arm may have a bent portion, and the protruding portion may be formed such that the upper edge extends toward a distal end of the front lifting arm along the bent portion.

A work vehicle includes: the machine body frame, in front of which the front loader is attached; a front guard attached to the machine body frame and disposed in front of a hood; and a stand extending frontward from the masts, the stand being configured to rotate integrally with the masts, wherein the stand is configured to hold a posture of the front loader in a case where the masts are rotated and are removed from the machine body frame, and the stand is disposed such that a distal end portion of the stand is hidden behind the front guard in a case where the masts are rotated and are mounted to the machine body frame.

Advantageous Effects of Invention

An aspect of the present invention can improve the load capacity of a lifting arm that constitutes a front loader, by reducing a stress concentration which may occur in a welded portion of the lifting arm.

DESCRIPTION OF EMBODIMENTS

A front loader according to an embodiment of the present invention enables various types of works (e.g., excavation) by being mounted to a work vehicle (e.g., a tractor) serving as a machine body. In this embodiment, a tractor is taken as an example of the work vehicle in describing the front loader.

Figure 1:
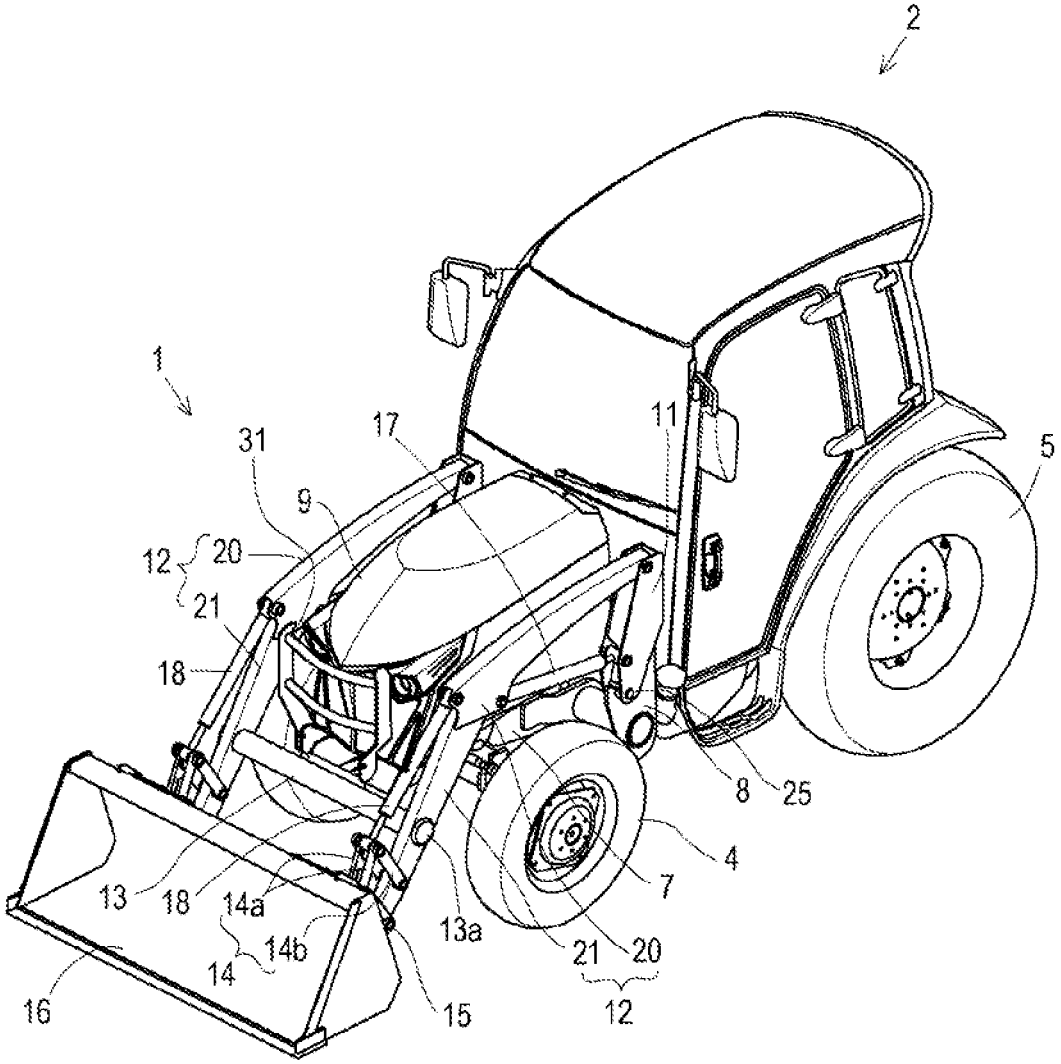
FIG. 1 is a perspective view of a work vehicle to which a front loader is mounted.
Figure 2:
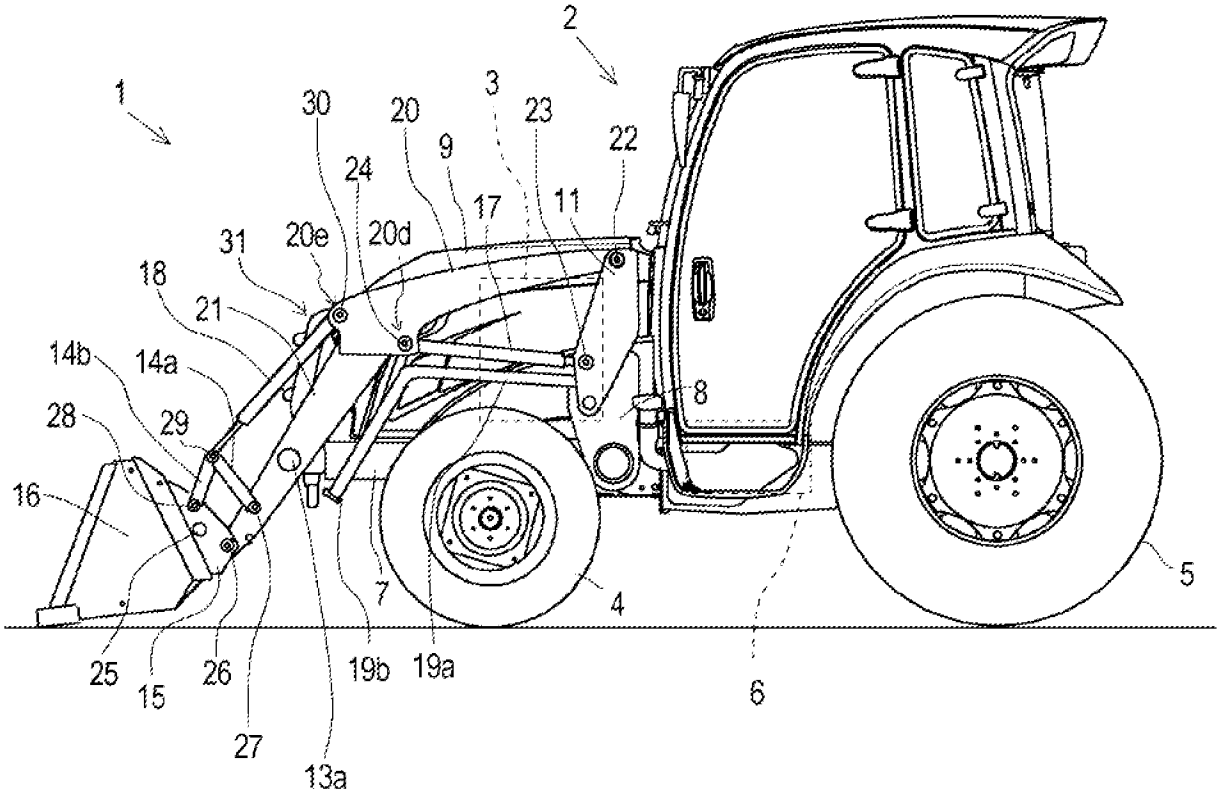
FIG. 2 is a side view of the work vehicle to which the front loader is mounted.

An overall configuration of a tractor 2 to which a front loader 1 is mounted will be described with reference to FIG. 1 and FIG. 2.

The tractor 2 travels by front wheels 4 and rear wheels 5 being driven by power of an engine 3. The power supplied from the engine 3 is transmitted respectively to the front wheels 4 and to the rear wheels 5 via a transmission case 6.

In the tractor 2, a hydraulic pump (not shown) which is driven by power of the engine 3 feeds hydraulic oil under pressure, so that the hydraulic oil is supplied to the front loader 1 which is mounted to a machine body frame 7, thereby enabling excavation work and the like.

A configuration of the front loader 1 will be described with reference to FIG. 1 to FIG. 3. The front loader 1 is detachably provided to the tractor 2. The front loader 1 includes a pair of left and right masts 11 provided to the machine body frame 7 of the tractor 2 in a detachable manner, a pair of left and right lifting arms 12 coupled to the masts 11 in a vertically (up-down) rotatable manner, a connecting pipe 13 that couples the pair of left and right lifting arms 12 to each other, a pair of left and right bucket links 14, a pair of left and right bucket brackets 15, work equipment 16 mounted to the pair of left and right lifting arms 12, a pair of left and right arm cylinders 17, a pair of left and right bucket cylinders 18, a stand 19, and a front guard 31 that protects a front portion of the tractor 2. The front loader 1 performs works by lifting and lowering the work equipment 16. In this embodiment, a bucket is adopted as the work equipment 16.

To left and right side plates of the machine body frame 7, a pair of left and right loader mounts 8 are fixed, respectively. To the pair of left and right loader mounts 8, the pair of left and right masts 11 are attached in a detachable manner.

The lifting arm 12 includes a rear lifting arm 20 and a front lifting arm 21 being welded to each other. The rear lifting arm 20 is attached to the mast 11. The front lifting arm 21 is attached to the work equipment 16. The rear lifting arm 20 and the front lifting arm 21 are fixed to each other so as to form a predetermined angle, so that the lifting arm 12 has a boomerang shape when viewed from lateral sides of the machine body.

Each of the rear lifting arms 20 is, at its rear end, pivotally supported on an upper end portion of each mast 11 via a pivotal support shaft 22 which is disposed with its longitudinal direction being parallel to a machine body width direction. In this configuration, a front portion of the front loader 1 is vertically rotatable about the pair of left and right pivotal support shafts 22.

A front end portion of the rear lifting arm 20, which is fixed to a rear end portion of the front lifting arm 21, has its width increasing in a direction substantially perpendicular to an inclination direction (longitudinal direction) of the front lifting arm 21. In a lower portion of the front end portion of the rear lifting arm 20 having the increasing width, an arm cylinder bracket portion 20*d* for attachment of the arm cylinder 17 is formed, and in an upper portion of the front end portion of the rear lifting arm 20 having the increasing width, a bucket cylinder bracket portion 20*e* for attachment of the bucket cylinder 18 is formed.

In a front end portion of the mast 11, a distal end portion (rear end) of a piston rod of the arm cylinder 17 is pivotally supported at a location corresponding to the vertically middle of the mast 11, via a pivotal support shaft 23 which is disposed with its longitudinal direction being parallel to the machine body width direction. In the arm cylinder bracket portion 20*d* of the rear lifting arm 20, a proximal end portion (front end) of the arm cylinder 17 is pivotally supported via a pivotal support shaft 24 which is disposed with its longitudinal direction being parallel to the machine body width direction. The pair of left and right arm cylinders 17 serve as an actuator for vertically rotating the front loader 1 about the pivotal support shaft 23. The angle through which the front loader 1 is vertically rotated, which means the angle of the pair of left and right lifting arms 12 relative to the masts 11, is adjusted by simultaneous extension and retraction of the piston rods of the pair of left and right arm cylinders 17.

The front lifting arms 21 have their longitudinally (front-rear) middle portions being coupled to each other by the connecting pipe 13 which is disposed with its longitudinal direction being parallel to the machine body width direction, and thereby the front lifting arms 21 are integrally fixed. The bucket brackets 15 are coupled to each other via a coupling shaft 25 which is disposed with its longitudinal direction being parallel to the machine body width direction. The front end of the front lifting arm 21 is attached to the work equipment 16 via the bucket bracket 15. The bucket bracket 15 pivotally supports the front end of the front lifting arm 21 via a pivotal support shaft 26 which is disposed with its longitudinal direction being parallel to the machine body width direction. Accordingly, the bucket brackets 15 and the work equipment 16 are vertically rotatable relative to the pair of left and right lifting arms 12 via the pair of left and right pivotal support shafts 26. Although this embodiment adopts a bucket as the work equipment 16, another work equipment may be attached.

Each of the bucket links 14 includes an arm side link member 14*a* and a bucket side link member 14*b*. The arm side link member 14*a* is, at its lower end, pivotally supported on a longitudinally middle portion of the front lifting arm 21 via a pivotal support shaft 27 which is disposed with its longitudinal direction being parallel to the machine body width direction. The bucket side link member 14*b* is, at its lower end, pivotally supported on an upper portion of the bucket bracket 15 via a pivotal support shaft 28 which is disposed with its longitudinal direction being parallel to the machine body width direction.

Upper end portions of the arm side link member 14*a* and the bucket side link member 14*b* are placed to a pivotal support shaft 29 which is disposed with its longitudinal direction being parallel to the machine body width direction, and the distal end portion of the piston rod of the bucket cylinder 18 is placed to the pivotal support shaft 29. A proximal end portion of the bucket cylinder 18 is pivotally supported on the bucket cylinder bracket portion 20*e* of the rear lifting arm 20 via a pivotal support shaft 30 which is disposed with its longitudinal direction being parallel to the machine body width direction.

The pair of left and right bucket cylinders 18 serve as an actuator for longitudinally rotating the bucket brackets 15 about the pivotal support shaft 30. By simultaneous extension and retraction of the piston rods of the pair of left and right bucket cylinders 18, the joint angle of each bucket link 14, which means the angle formed between the arm side link member 14*a* and the bucket side link member 14*b*, is adjusted, so that the angle through which the bucket brackets 15 are longitudinally rotated relative to the lifting arms 12 is adjusted.

The lifting arm 12 will be described with reference to FIG. 3 to FIG. 5.

The rear lifting arm 20 has a rectangular shape with a hollow cross-section when viewed in a direction in which the rear lifting arm 20 extends. To be specific, the rear lifting arm 20 includes an upper frame 20*a* and a lower frame 20*b*, the upper frame 20*a* being made of a single metal plate that is bent twice such that a first side surface and a second side surface thereof are opposed to each other, the lower frame 20*b* closing an opening portion at the bottom of the upper frame 20*a*. Thus, the upper frame 20*a* has a substantially inverted U shape cross-section when viewed in a direction in which the upper frame 20*a* extends. An upper surface of the rear lifting arm 20, and more specifically an upper surface of the upper frame 20*a*, is curved in a side view. Although the rear lifting arm 20 is composed of the upper frame 20*a* and the lower frame 20*b*, this configuration is not limiting, and the rear lifting arm 20 may be formed integrally.

The front lifting arm 21 has a hollow, rectangular cross-section when viewed in a direction in which the front lifting arm 21 extends. To be specific, the front lifting arm 21 includes an upper frame 21*a* and a lower frame 21*b*, the upper frame 21*a* being made of a single metal plate that is bent twice such that a first side surface and a second side surface thereof are opposed to each other, the lower frame 21*b* closing an opening portion at the bottom of the upper frame 21*a*. Thus, the upper frame 21*a* has a substantially inverted U shape cross-section when viewed in a direction in which the upper frame 21*a* extends. Although the front lifting arm 21 is composed of the upper frame 21*a* and the lower frame 21*b*, this configuration is not limiting, and the front lifting arm 21 may be formed integrally.

The front lifting arm 21 is shaped such that its outer diameter with respect to the width direction is equal to the inner diameter of the rear lifting arm 20 with respect to the width direction. The rear end portion of the front lifting arm 21 is inserted into the front end portion of the rear lifting arm 20, and is welded (see FIG. 4 and FIG. 5). The front end portion of the rear lifting arm 20 and the rear end portion of the front lifting arm 21 overlap each other in a side view, and an overlap portion (insertion portion) between the rear lifting arm 20 and the front lifting arm 21 is welded, and thus they are fixed.

Figure 3:
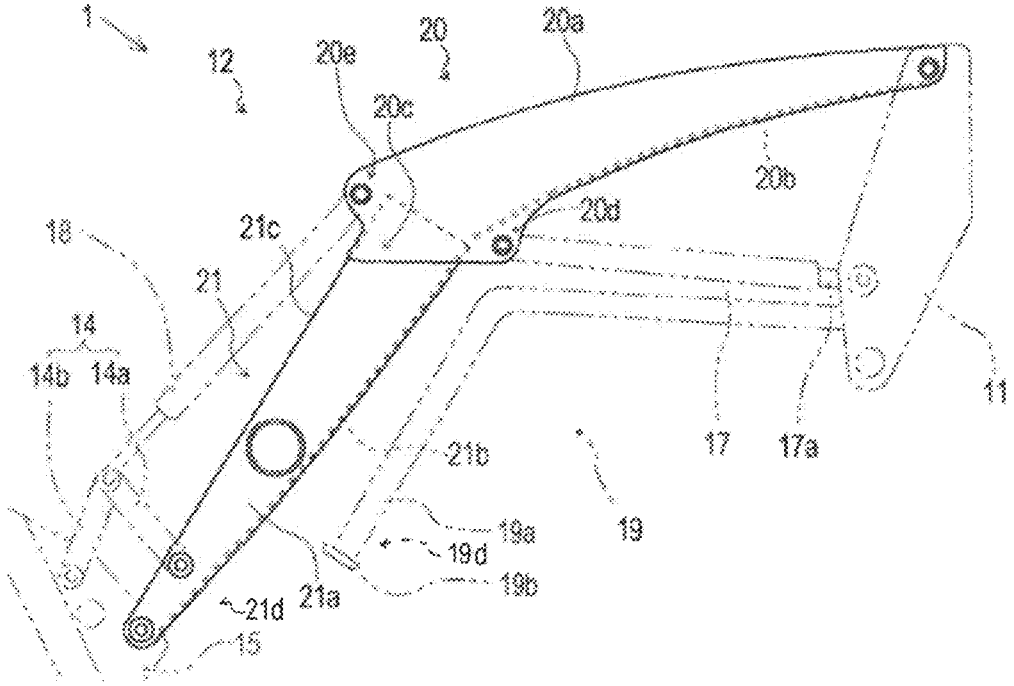
FIG. 3 is a side view of a lifting arm that constitutes the front loader.
Figure 4:
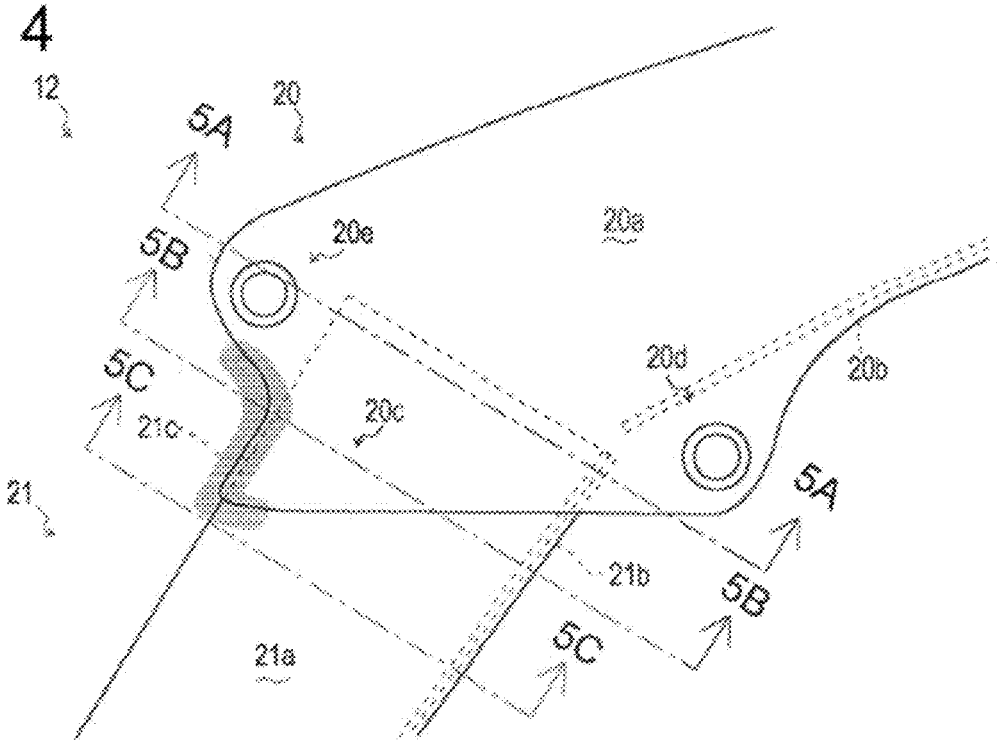
FIG. 4 is a side view showing a protruding portion of the lifting arm.

As shown in FIG. 3 and FIG. 4, a side plate of the rear lifting arm 20 at a location corresponding to the insertion portion has a protruding portion 20*c* that extends along a side plate of the front lifting arm 21. The protruding portion 20*c* is a portion of the side plate constituting the front end portion of the rear lifting arm 20, the portion protruding toward the distal end 21*d* of the front lifting arm 21 beyond a substantially straight line connecting the arm cylinder bracket portion 20*d* and the bucket cylinder bracket portion 20*e* to each other in a side view. The protruding portion 20*c* is provided so as to extend along the side plate of the front lifting arm 21, and the protruding portion 20*c* is welded to the side plate of the front lifting arm 21.

As shown in FIG. 4, the protruding portion 20*c* is provided so as to extend toward the distal end 21*d* of the front lifting arm 21 along a bent portion 21*c* of the front lifting arm 21. The bent portion 21*c* of the front lifting arm 21 is a bent portion of the metal plate constituting the front lifting arm 21. In this embodiment, the bent portion 21*c* includes a bent portion between the upper surface and a first side surface of the upper lifting arm 21*a* and a bent portion between the upper surface and a second side surface of the upper lifting arm 21*a*. The bent portion 21*c* is a top edge portion of the front lifting arm 21 (upper lifting arm 21*a*) in a side view.

As shown in FIG. 4, the protruding portion 20*c* is formed such that its cross-sectional area gradually decreases from its proximal end portion toward its distal end portion when viewed in a direction in which the front lifting arm 21 extends. The protruding portion 20*c* is formed so as to extend while curving from its proximal end portion on the bucket cylinder bracket portion 20*e* side toward the bent portion 21*c* of the front lifting arm 21, and then extend along the bent portion 21*c* of the front lifting arm 21. The protruding portion 20*c* is formed so as to extend from its proximal end portion on the arm cylinder bracket portion 20*d* side toward the bent portion 21*c* of the front lifting arm 21. The protruding portion 20*c* has its distal end portion curved.

Since the protruding portion 20*c* is provided so as to extend along the side plate of the front lifting arm 21, a length for welding can be obtained. Accordingly, the strength of connection between the front lifting arm 21 and the rear lifting arm 20 can be improved.

Since the protruding portion 20*c* is provided so as to extend along the side plate of the front lifting arm 21, a stress can be distributed over a portion hatched in FIG. 4. A stress occurring in a region adjacent to the bucket cylinder bracket portion 20*e* and near the bent portion 21*c* of the front lifting arm 21 (near the proximal end portion of the protruding portion 20*c*) can be distributed also to the distal end portion of the protruding portion 20*c*, as compared with when the protruding portion 20*c* is not provided. Thus, a stress concentration in a welded portion of the lifting arm 12 can be reduced.

The bent portion 21*c* of the upper frame 21*a* which constitutes the front lifting arm 21 has a high rigidity. Arranging the distal end portion of the protruding portion 20*c* on the bent portion 21*c* can avoid a stress concentration in a less rigid region (e.g., a central region of the side plate constituting the upper frame 21*a*). The avoidance of a stress concentration in a less rigid region can improve the load capacity of the lifting arm 12.

An end surface configuration of the overlap portion (insertion portion) where the front lifting arm 21 overlaps the rear lifting arm 20 and therearound will be described with reference to FIG. 5.

Figure 5A:
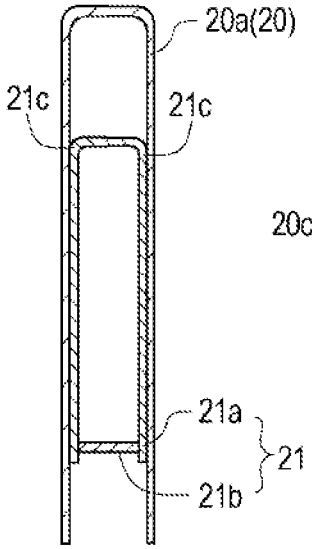
FIG. 5A is a diagram showing a cut end surface cut along the line 5A-5A of FIG. 4.

As shown in FIG. 5A, an end surface cut along the line 5A-5A of FIG. 4 includes a hollow end surface made up of the upper frame 21*a* and the lower frame 21*b* of the front lifting arm 21, and an end surface of the upper frame 20*a* having a substantially inverted U shape cross-section when viewed in the direction in which the front lifting arm 21 extends.

Figure 5B:
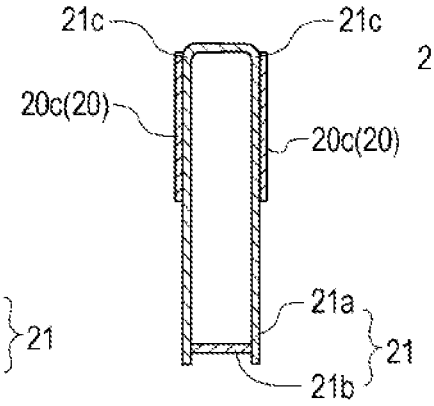
FIG. 5B is a diagram showing a cut end surface cut along the line 5B-5B of FIG. 4.

As shown in FIG. 5B, an end surface cut along the line 5B-5B of FIG. 4 includes a hollow end surface made up of the upper frame 21*a* and the lower frame 21*b* of the front lifting arm 21, and an end surface of the protruding portion 20*c* which constitutes the side plate of the rear lifting arm 20.

Figure 5C:
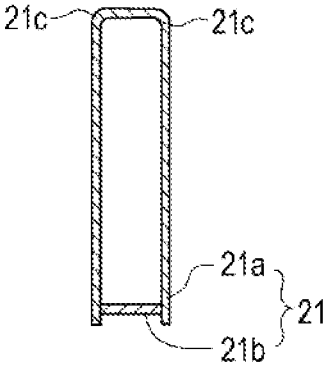
FIG. 5C is a diagram showing a cut end surface cut along the line 5C-5C of FIG. 4.

As shown in FIG. 5C, an end surface cut along the line 5C-5C of FIG. 4 includes only a hollow end surface made up of the upper frame 21*a* and the lower frame 21*b* of the front lifting arm 21.

Providing the protruding portion 20*c* allows members in the welded portion of the lifting arm 12 to have their cross-sectional areas gradually changing, as shown in FIG. 5A to FIG. 5C. This can prevent an abrupt change in section modulus of the welded portion of the lifting arm 12, and thus can reduce a stress concentration. The reduction in a stress concentration can improve the load capacity of the lifting arm 12.

Since the protruding portion 20*c* is curved from its proximal end portion on the bucket cylinder bracket portion 20*e* side toward the bent portion 21*c* of the front lifting arm 21, an abrupt change in section modulus can be further prevented, and thus a stress concentration can be reduced.

Likewise, since the distal end portion of the protruding portion 20*c* is curved, an abrupt change in section modulus can be further prevented, and thus a stress concentration can be reduced.

Figure 6A:
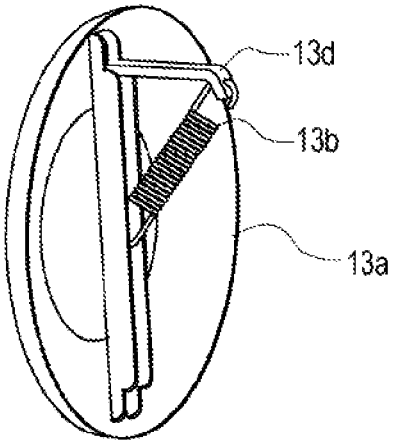
FIG. 6A is a perspective view showing a covering that closes an opening portion of a connecting pipe.
Figure 6B:
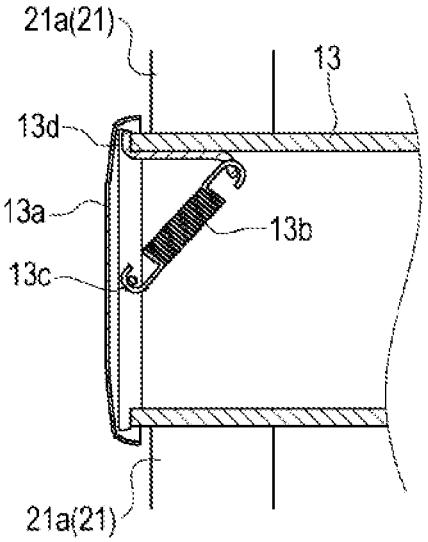
FIG. 6B is a partial cross-sectional view showing a state where an end portion of the connecting pipe is closed.
Figure 6C:
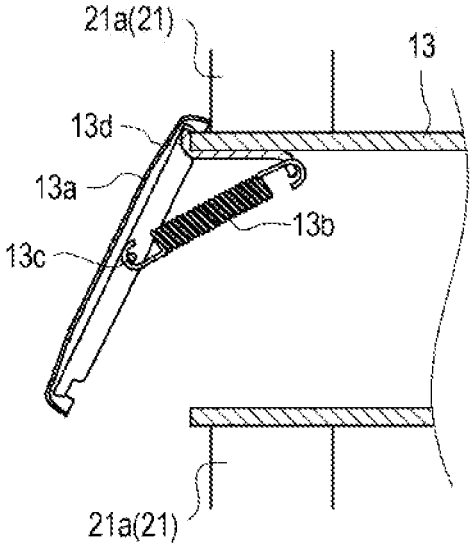
FIG. 6C is a partial cross-sectional view showing a state where the end portion of the connecting pipe is opened.
Figure 7:
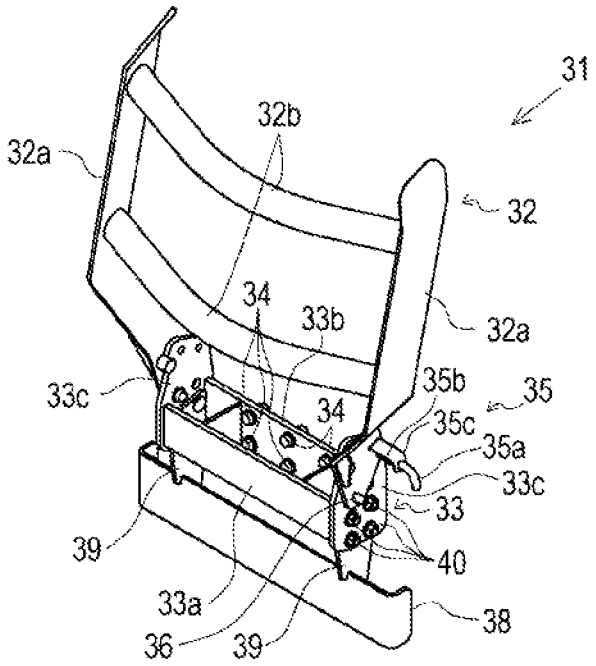
FIG. 7 is a perspective view of a front guard.
Figure 8A:
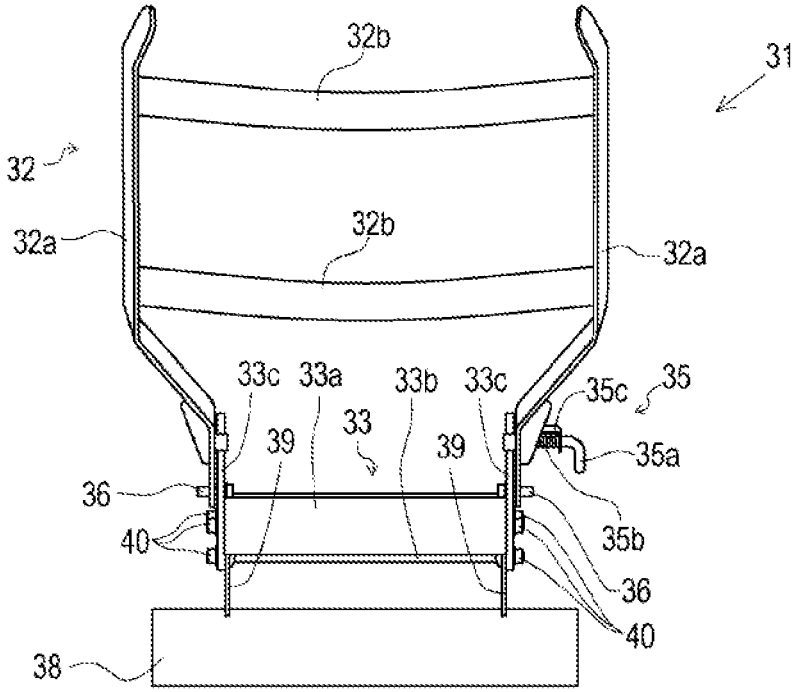
FIG. 8A is a front view of the front guard.
Figure 8B:
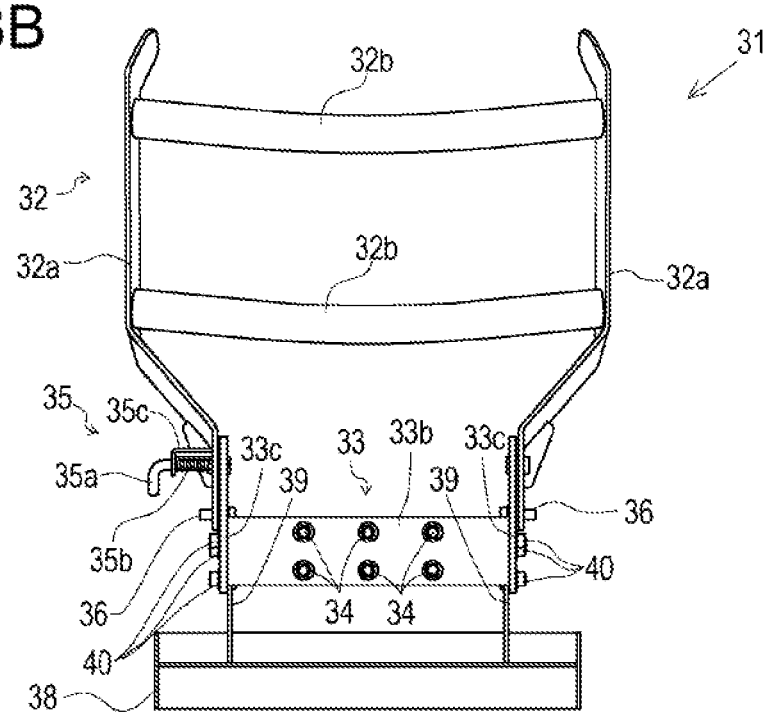
FIG. 8B is a rear view of the front guard.
Figure 9A:
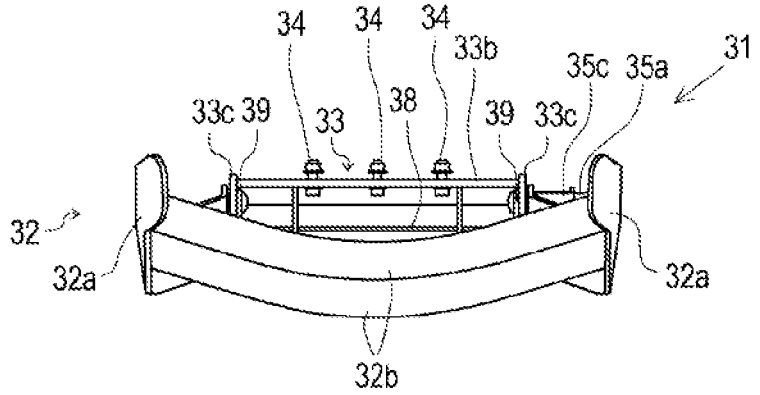
FIG. 9A is a top plan view of the front guard.
Figure 9B:
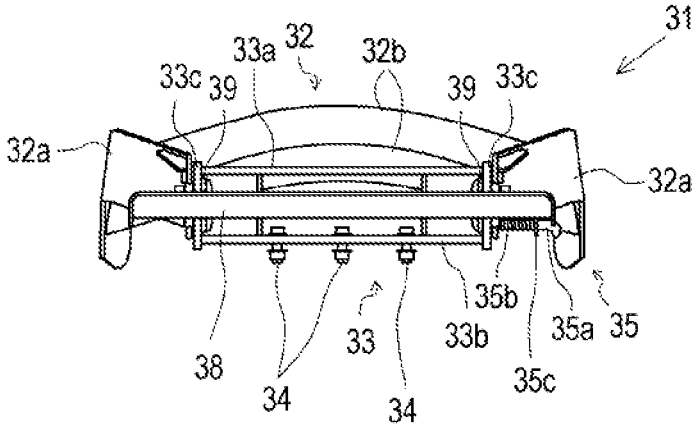
FIG. 9B is a bottom plan view of the front guard.
Figure 10A:
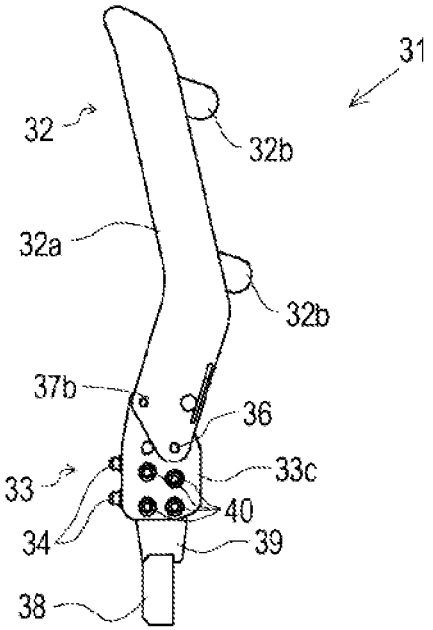
FIG. 10A is a right side view of the front guard.
Figure 10B:
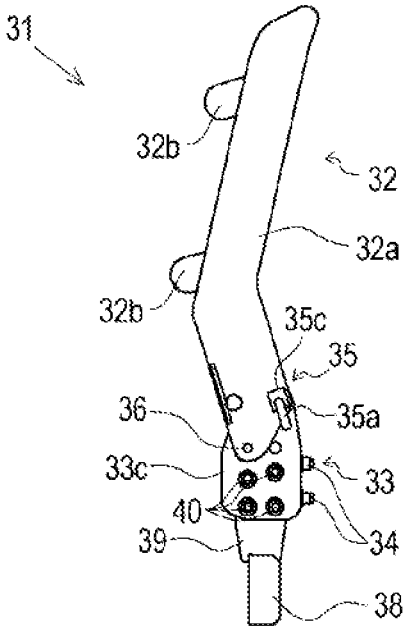
FIG. 10B is a left side view of the front guard.

The connecting pipe 13 which couples the pair of left and right lifting arms 12 (see FIG. 1) will be described with reference to FIG. 6.

The connecting pipe 13 is in the shape of a hollow pipe whose opposite ends are opened. The connecting pipe 13 is disposed with its longitudinal direction being parallel to the machine body width direction, and its end portions penetrate through middle portions of the respective front lifting arms 21 (upper frames 21*a*). The end portions of the connecting pipe 13 are provided with coverings 13*a* that close their opening portions.

The covering 13*a* is attached to the opening portion of the connecting pipe 13 via an elastic member 13*b*. A first end of the elastic member 13*b* is attached to a support shaft 13*c* arranged in a central portion of an inner peripheral surface of the covering 13*a*. A second end of the elastic member 13*b* is attached to a spring catch 13*d* arranged on an interior wall surface of the connecting pipe 13. The spring catch 13*d* is a substantially L shaped member, having a first end thereof rotatably supported on an end portion of the inner peripheral surface of the covering 13*a*. The spring catch 13*d* is disposed such that a second end thereof is positioned on the interior wall surface of the connecting pipe 13. The elastic member 13*b* is given a biasing force such that the covering 13*a* closes the opening portion of the connecting pipe 13.

In the above-described configuration, the covering 13*a* can be removed by an operator turning the covering 13*a* against the biasing force of the elastic member 13*b*. Such a configuration enables the covering 13*a* to be easily removed without the need to use of any tool or the like.

Since the connecting pipe 13 is hollow and its end portion is openable, a storage space can be formed in the connecting pipe 13. If, for example, a user guide for the front loader 1 (see FIG. 1) is put inside the connecting pipe 13, a situation in which the user guide remains left in the tractor 2 (see FIG. 1) when the front loader 1 is detached from the tractor 2 can be prevented. Thus, an operator can always readily check how to use the front loader 1. Preferably, the lifting arm 12 (see FIG. 1) is given a cationic coating. Due to application of the cationic coating, an anti-corrosion protective film layer is formed on the lifting arm 12, which can prevent the interior of the connecting pipe 13 from rusting.

The front guard 31 will be described with reference to FIG. 1, FIG. 2, FIG. 7, FIG. 8, FIG. 9, and FIG. 10.

The front guard 31 is provided in front of a hood 9. The front guard 31, which is for protecting the front portion of the tractor 2, is fixed to the machine body frame 7.

The front guard 31 includes an upper frame 32 and a fixing plate 33, the upper frame 32 being disposed in front of the hood 9, the fixing plate 33 fixing the upper frame 32 to the machine body frame 7.

The upper frame 32 includes a pair of left and right side frame members 32*a* and coupling members 32*b* coupling the side frame members 32*a* to each other. Each side frame member 32*a* is made of a plate-like member with a substantially rectangular shape being bent twice in its middle portion. The side frame members 32*a* are disposed with their longitudinal direction being parallel to the vertical direction, and are opposed to each other.

The two coupling members 32*b* coupling the side frame members 32*a* to each other are provided to upper portions of the side frame members 32*a*. The two coupling members 32*b* are juxtaposed in the vertical direction. The coupling member 32*b* is made of a hollow pipe. The coupling members 32*b* provided to the upper portions of the side frame members 32*a* are disposed with their longitudinal direction being parallel to the lateral (left-right) direction such that the coupling members 32*b* connect opposing surfaces of the side frame members 32*a* to each other. The coupling member 32*b* is curved frontward in conformity with the shape of the front portion of the hood 9.

The fixing plate 33 includes plate-like members 33*a*, 33*b* having vertically elongated shapes and plate-like members 33*c*, 33*c* having vertically elongated shapes, the plate-like members 33*a*, 33*b* being juxtaposed in the longitudinal direction, the plate-like members 33*c*, 33*c* coupling end portions of the plate-like members 33*a*, 33*b* to each other.

A plurality of bolts 34 for fixing the plate-like member 33*b* to the machine body frame 7 is provided in the plate-like member 33*b*. The plurality of bolts 34 fasten the plate-like member 33*b* to a front plate of the machine body frame 7, and thereby the fixing plate 33 (front guard 31) can be attached to the tractor 2.

One of the plate-like members 33*c* included in the front guard 31 is provided with a lock mechanism 35 that fixes a posture of the upper frame 32 at two positions. The lock mechanism 35 includes a lock pin 35*a* and an elastic member 35*b*, the lock pin 35*a* penetrating through the side frame member 32*a* and the plate-like member 33*c*, the elastic member 35*b* biasing the lock pin 35*a* inward in the width direction.

The lock pin 35*a* has a substantially L shape that extends outward of the machine body and then is bent downward. The lock pin 35*a* is supported by one of the side frame members 32*a* having the lock mechanism 35 and a support member 35*c* provided to this side frame member 32*a* such that the lock pin 35*a* is freely movable in the lateral direction. The elastic member 35*b* is disposed between the support member 35*c* and the side frame member 32*a* so as to bias the lock pin 35*a* inward.

Each side frame member 32*a* is rotatably supported on each plate-like member 33*c* via a rotation support shaft 36. The side frame member 32*a* has two through holes (not shown) through which the lock pin 35*a* can penetrate. The two through holes are equidistant from the rotation support shaft 36.

In the above-described configuration, the inclination of the upper frame 32 relative to the plate-like members 33*c* can be changed by an operator transferring the lock pin 35*a* from one through hole to the other through hole or from the other through hole to the one through hole against the biasing force of the elastic member 35*b*. To open or close the hood 9 with the front guard 31 mounted, the lock pin 35*a* is transferred from one through hole to the other through hole to change the inclination of the upper frame 32 relative to the plate-like members 33*c*, so that the hood 9 can be prevented from contacting the upper frame 32 of the front guard 31, thus allowing the hood 9 to be opened or closed in safety.

Figure 11:
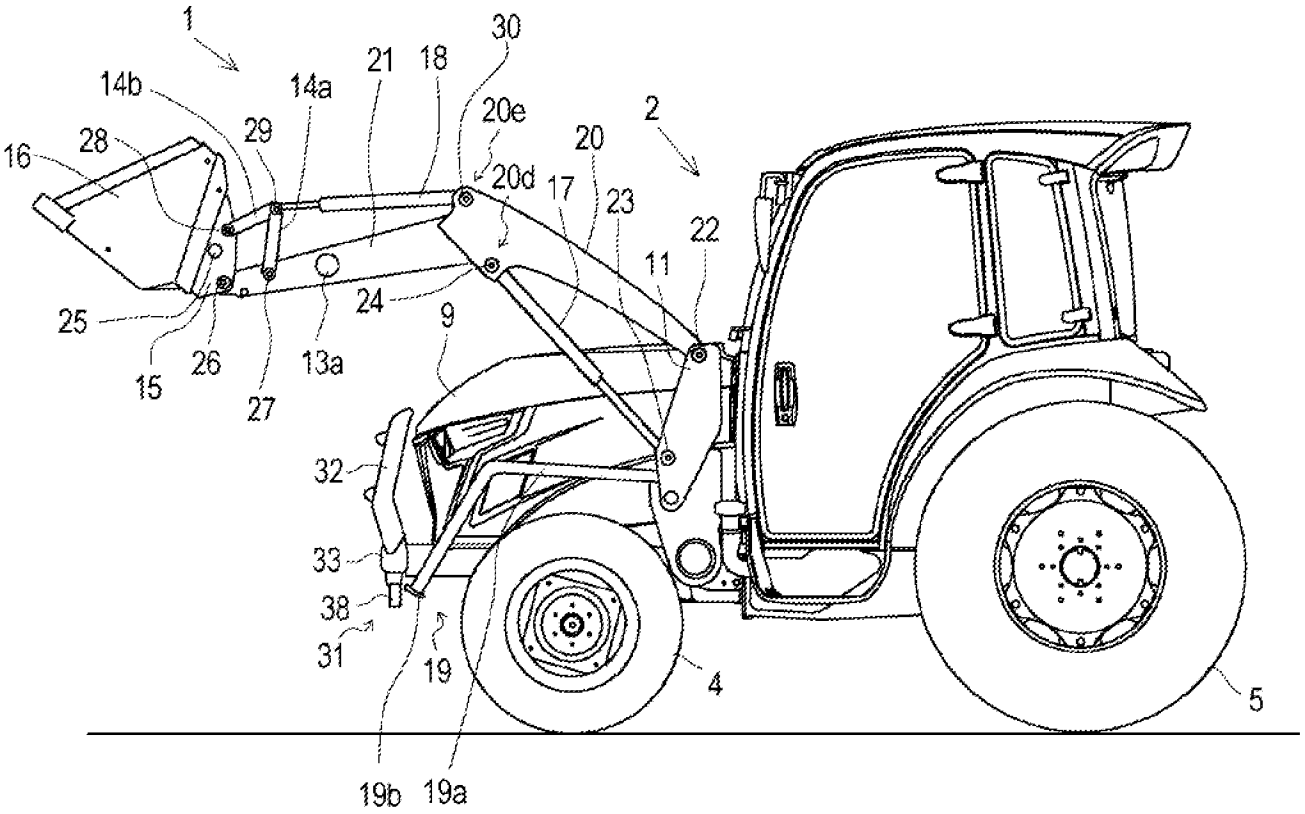
FIG. 11 is a side view of the work vehicle with the front loader rotated upward.

As thus far described, since the upper frame 32 of the front guard 31 is provided, the hood 9 is not exposed to the front of the machine body of the tractor 2 even when works or traveling is performed with the front loader 1 rotated upward as shown in FIG. 11, for example. Thus, the hood 9 can be protected. In addition, the front guard 31 can be removed from the tractor 2 by removal of the fixing plate 33 from the machine body frame 7. Thus, the front guard 31 can be easily attached to or detached from another tractor.

The front guard 31 further includes a stand guard 38 that protects the stand 19, as shown in FIG. 7 to FIG. 11. The stand guard 38 is made of a plate-like member with a substantially rectangular shape being bent in its both end portions to form a substantially C shape in a plan view. Except while the stand 19 is being attached or detached, the stand guard 38 is disposed in front of a distal end portion 19*d* of the stand 19 and, in this embodiment, below the fixing plate 33. The stand guard 38 is fixed to the machine body frame 7 via under stays 39 fixed to the plate-like members 33*c* of the front guard 31. The plate-like members 33*c* and the under stays 39 are fastened to each other with a plurality of bolts 40.

The stand 19 will be described with reference to FIG. 11, FIG. 12, and FIG. 13.

In the front loader 1, the stand 19 is provided at a position below the pair of left and right lifting arms 12. The stand 19 is for holding a posture of the pair of left and right lifting arms 12 so as to allow attachment or detachment thereof when the front loader 1 is attached to or detached from the tractor 2. The stand 19 includes shaft members 19*a*, ground plates 19*b*, and a joint member 19*c* (see FIG. 13), the shaft members 19*a* extending frontward from the respective masts 11, the ground plates 19*b* being fixed to the distal ends of the respective shaft members 19*a*, the joint member 19*c* coupling the shaft members 19*a* to each other.

The shaft member 19*a* is bent in its middle portion in a side view, and extends downward from the bent portion, and has the ground plate 19*b* fixed to the lower end (distal end) thereof. The shaft members 19*a* have their distal end portions coupled and fixed to each other by the joint member 19*c* (see FIG. 13) which is disposed with its longitudinal direction being parallel to the machine body width direction. The shaft members 19*a* have their proximal end portions fixed to the masts 11. Accordingly, as the masts 11 rotates relative to the loader mounts 8, the stand 19 rotates integrally with the masts 11. The rotation of the mast 11 makes the front loader 1 detachable from the tractor 2.

Figure 12A:
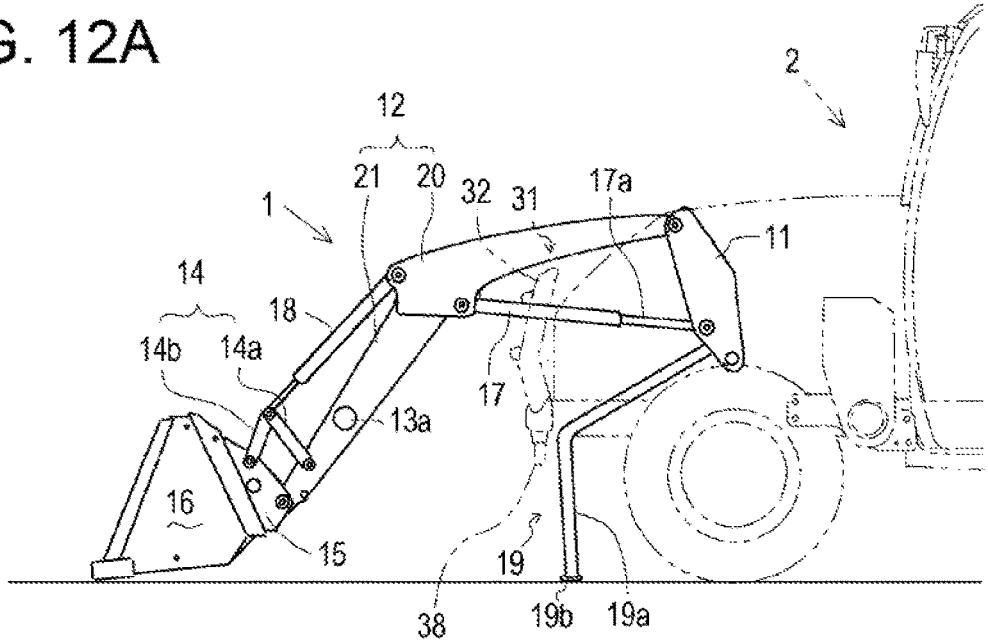
FIG. 12A is a side view showing a stand while the front loader is being attached or detached.

As shown in FIG. 12A, while the front loader 1 is being attached to or detached from the tractor 2, that is, while the stand 19 is in use, the ground plates 19*b* included in the stand 19 are grounded on a placing plane where the work equipment 16 of the front loader 1 is placed such that a posture of the pair of left and right lifting arms 12 is held so as to allow attachment or detachment thereof.

In attachment or detachment of the front loader 1 to or from the tractor 2, the stand 19 fixed to the masts 11 rotates along with rotation of the masts 11, so that the stand 19 is grounded on a placing plane where the work equipment 16 of the front loader 1 is placed. This configuration allows the front loader 1 to be easily attached or detached.

Figure 12B:
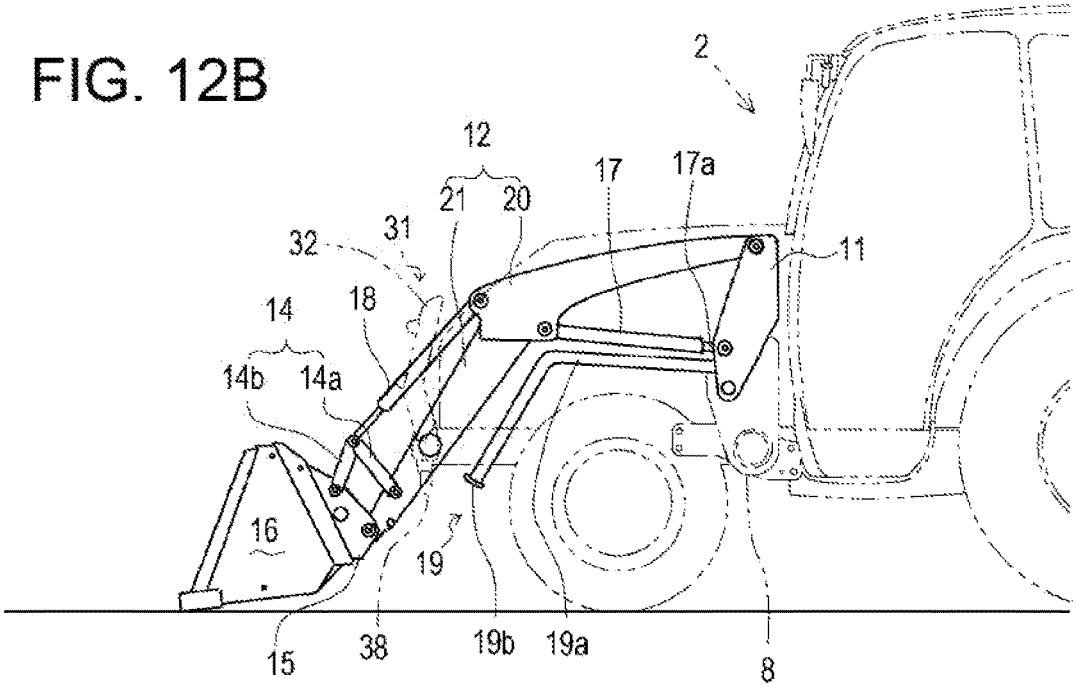
FIG. 12B is a side view showing the stand while the front loader is mounted to the work vehicle.

As shown in FIG. 12B, when the front loader 1 is mounted to the tractor 2, that is, when the stand 19 is retracted (e.g., when an excavation work is performed), the ground plates 19*b* included in the stand 19 are at the rear of a lower portion of the front guard 31.

In mounting the front loader 1 to the tractor 2, the stand 19 fixed to the masts 11 rotates along with rotation of the masts 11, so that the stand 19 is positioned at the rear of the front guard 31.

Figure 13:
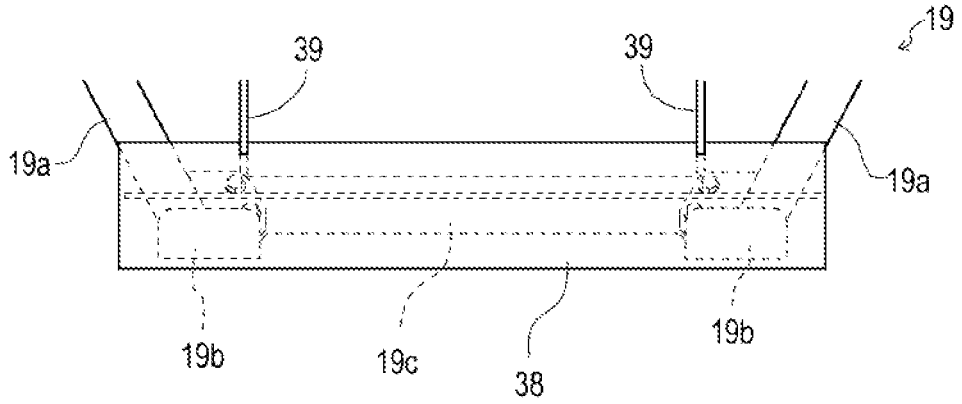
FIG. 13 is a front view of a stand guard included in the front guard.

As shown in FIG. 12A and FIG. 13, in a state where the front loader 1 is mounted to the tractor 2, the distal end portion 19*d* (e.g., the ground plates 19*b* and the joint member 19*c*) of the stand 19 is hidden behind the stand guard 38 included in the front loader 1, when viewed from the front side of the front loader 1. The distal end portion 19*d* of the stand 19 is disposed so as to fall within the width and height of the stand guard 38 when viewed from the front side of the front loader 1. In other words, the stand 19 is provided such that the distal end portion 19*d* of the stand 19 is located within a range of longitudinal projection of the stand guard 38.

As described above, the stand 19 is provided such that the distal end portion 19*d* of the stand 19 is located within a range of longitudinal projection of the stand guard 38 when the front loader 1 is mounted. Therefore, for example, even in a case where the tractor 2 travels ahead into deposited soil with the front loader 1 rotated upward as shown in FIG. 11, the stand 19 is not exposed to the front of the machine body of the tractor 2. Thus, the stand 19 can be protected. Since the distal end portion 19*d* of the stand 19 can be protected by the front guard 31, a reduced strength of the stand 19 may be allowed. Accordingly, the stand 19 can be lightweighted.

INDUSTRIAL APPLICABILITY

The present invention is applicable to a front loader and to a work vehicle.

As another solution to the problems of the present invention, a front loader according to another aspect of the present invention is a front loader including: a pair of left and right masts provided to a machine body frame of a work vehicle in a detachable manner; a pair of left and right lifting arms coupled to the masts in a vertically rotatable manner; and work equipment mounted to the pair of left and right lifting arms, wherein each of the lifting arms includes a rear lifting arm attached to one of the masts and a front lifting arm attached to the work equipment, each of the front lifting arm and the rear lifting arm has a hollow, rectangular cross-section when viewed in a direction in which the front lifting arm or the rear lifting arm extends, a rear end portion of the front lifting arm is inserted into a front end portion of the rear lifting arm, and is welded, a side plate of the rear lifting arm at a location corresponding to the insertion portion has a protruding portion that extends along a side plate of the front lifting arm, and the protruding portion is welded.

The front lifting arm may have a bent portion, and the protruding portion may be formed so as to extend toward a distal end of the front lifting arm along the bent portion.

The front loader may further include: a front guard that protects a front portion of the work vehicle, the front guard being provided in front of the work vehicle; and a stand that holds a posture of the front loader during attachment or detachment of the front loader, the stand extending frontward from the masts, wherein in a state where the front loader is mounted to the work vehicle, a distal end portion of the stand may be hidden behind the front guard in a front view.

REFERENCE SIGNS LIST

1: front loader, 2: tractor, 3: engine, 7: machine body frame, 8: loader mount, 11: mast, 12: lifting arm, 13: connecting pipe, 16: work equipment, 17: arm cylinder, 18: bucket cylinder, 19: stand, 19*a*: shaft member, 19*b*: ground plate, 20: rear lifting arm, 20*a*: upper frame, 20*b*: lower frame, 20*c*: protruding portion, 21: front lifting arm, 21*a*: upper frame, 21*b*: lower frame, 21*c*: bent portion, 31: front guard, 32: upper frame, 33: fixing plate, 38: stand guard

The invention claimed is:

1. A front loader comprising:

a pair of left and right masts provided to a machine body frame in a detachable manner;

a pair of left and right lifting arms coupled to the masts in a vertically rotatable manner; and a work equipment mounted to the pair of left and right lifting arms, wherein each of the lifting arms includes a rear lifting arm attached to one of the masts and a front lifting arm attached to the work equipment, the front lifting arm having an insertion portion to be inserted into the rear lifting arm, the rear lifting arm has a side plate whose front end portion is provided with a protruding portion that extends along a side plate of the front lifting arm, and an upper edge of the protruding portion extends along the side plate of the front lifting arm farther than a lower edge of the protruding portion, and under a state where the front lifting arm is inserted into the rear lifting arm, an overlap portion where the insertion portion overlaps the protruding portion is welded so that the front lifting arm is fixed to the rear lifting arm.

2. The front loader according to claim 1, wherein the upper edge of the protruding portion is curved in an S-shape.

3. The front loader according to claim 1, wherein the front lifting arm has a bent portion, and the protruding portion is formed such that the upper edge extends toward a distal end of the front lifting arm along the bent portion.

4. A work vehicle comprising:

the machine body frame, in front of which the front loader according to claim 1 being attached;

a front guard attached to the machine body frame and disposed in front of a hood; and a stand extending frontward from the masts, the stand being configured to rotate integrally with the masts, wherein the stand is configured to hold a posture of the front loader in a case where the masts are rotated and are removed from the machine body frame, and the stand is disposed such that a distal end portion of the stand is hidden behind the front guard in a case where the masts are rotated and are mounted to the machine body frame.

* * * * *